United States Patent [19]

Sakaida et al.

[11] Patent Number: 4,634,301

[45] Date of Patent: Jan. 6, 1987

[54] PRINT HEAD WITH TORSION SPRING

[75] Inventors: Atsuo Sakaida, Gifu; Masafumi Kawaura, Nagoya; Yasuji Chikaoka, Shippocho; Hiroshi Iwata, Nagoya; Kiyomitsu Asano, Musashino, all of Japan

[73] Assignees: Nippon Telecommunication Engineering Company, Tokyo; Brother Industries, Ltd., Nagoya, both of Japan

[21] Appl. No.: 662,247

[22] Filed: Oct. 18, 1984

[30] Foreign Application Priority Data

Oct. 20, 1983 [JP] Japan ..... 58-163199[U]
Oct. 20, 1983 [JP] Japan ..... 58-163202[U]

[51] Int. Cl.[4] ..... B41J 3/12

[52] U.S. Cl. ..... 400/124; 400/157.2; 101/93.05; 101/93.48; 335/270; 335/274

[58] Field of Search ..... 400/124; 267/57; 101/93.05, 93.29, 93.48; 335/270, 274

[56] References Cited

U.S. PATENT DOCUMENTS 3,516,682 6/1970 Klanner et al. ..... 267/57
4,368,353 1/1983 Ando et al. ..... 101/93.04
4,521,122 6/1985 Schäfer ..... 400/124

FOREIGN PATENT DOCUMENTS 568665 1/1983 Japan ..... 400/124

*Primary Examiner*—Edgar S. Burr
*Assistant Examiner*—David A. Wiecking
*Attorney, Agent, or Firm*—Kane, Dalsimer, Kane, Sullivan and Kurucz

[57] ABSTRACT

A print head for dot printers comprising a plurality of actuators each including an armature supported on a holder through a torsion spring and having at its end a printing wire. The torsion spring is inserted in and bonded to the inner wall of through-holes of the bifurcated end portion of one of the armature and holder and to the inner wall of through-hole of the other of them, and has larger diameter portions fitted in the through-holes and smaller diameter portions interposed between the larger diameter portions. The smaller diameter portions of the torsion spring are formed in the concave section to avoid the concentration of torsional stress in the stepped boundary portions. Further, the opposite end portion of the other of said holder and armature made larger in thickness than the axial length of the torsion spring from the reason in strength, is forced at both end openings of the through hole with bevelling or facing portions, whereby the armature can be swung with uniform spring force of the torsion spring without being adversely affected by solder material leaked out.

4 Claims, 9 Drawing Figures

PRINT HEAD WITH TORSION SPRING

BACKGROUND OF THE INVENTION

This invention relates to a print head mounted in an impact type dot matrix printer, and more particularly to a plurality of actuators each having a torsion spring interposed between an armature having a printing wire at its end and a holder retained in the print head.

In each of the actuators of such type of print head, the armature having a printing wire at its end is supported through the torsion spring on the holder retained in the print head, and the armature at the time of printing operation is driven for swinging movement so as to print letters on a paper material with the end of the printing wire. The base end of the armature is located between the bifurcated ends of the holder and the torsion spring inserted in and bonded to the inner walls of through holes provided in both the bifurcated end portion of the holder and the base end of the armature. The torsion spring is formed with larger diameter cylindrical portions in the sections to be bonded to the inner walls of the through holes of both the bifurcated ends of the holder and the base end of the armature, and is formed with smaller diameter cylindrical portions in the sections between these larger diameter portions, with each of the boundary portions between the larger and smaller diameter portions having a little radius of fillet. However when each of the armatures has been swung for printing operation, torsional stress is concentrated in the boundary portions between the larger and smaller diameter portions, which often resulted in breakage of the torsion spring.

On the other hand, as shown in FIG. 7 the end 42*a* of the armature 42 is made larger in thickness than the axial length of the larger diameter portion 43*c* of the torsion spring 43. This is because the end 42*a* of the armature 42 must have a strength which resists dynamic bending applied thereto when the armature 42 has been swung, and also because if the larger diameter portion 43*c* is made equal in axial length to the thickness of the end 42*a* of the armature 42, the entire length of the torsion spring 43 becomes larger, which will inevitably result in larger diameter of the print head. Such greater thickness of the end of the armature caused the solder material 44 leaked out at the time of brazing to fill the spaces between the intermediate portions 43*c*, 43*d* and the through hole 42*b*, which in turn caused change in a spring constant of the torsion spring 43. As a result, it was impossible to swing the armature 42 with a substantially uniform torque of the torsion spring.

SUMMARY OF THE INVENTION

It is an object of the invention to provide a print head which has a plurality of actuators each having a torsion spring interposed between a holder and an armature and enables torsional stress in the boundary portions between the larger diameter portions and the intermediate portions to be reduced, and which is higher in durability and reliability.

It is another object of the invention to provide a print head which has a plurality of actuators each having an armature improved in the bonding portion between the armature and a torsion spring so that solder material leaked out may not adversely affect a spring constant of the torsion spring.

According to one aspect of the invention, there is provided a print head wherein one of said holder and armature has bifurcated end portion and the other of said holder and armature has an opposite end portion located between said bifurcated ends, said bifurcated end portion and said opposite end portion having through-holes which are provided in axial alignment relation with one another, and a torsion spring is inserted in and bonded to the inner wall of said through-hole, said torsion spring having larger diameter portions in the sections to be bonded to the bifurcated end portions and the opposite end portion, and having concave portions in the section interposed between the larger diameter portions.

Other objects and aspects of the invention will become apparent from the following description with reference to the accompanying drawings.

DETAILED DESCRIPTION OF THE PREFERRED EMBODIMENTS

Figure 1:
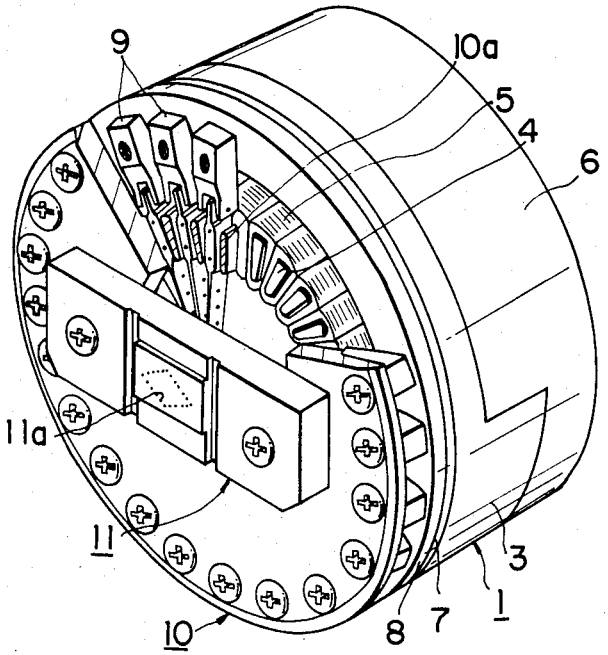
FIG. 1 is a perspective view, with parts partially broken away, of a print head according to the invention.
Figure 2:
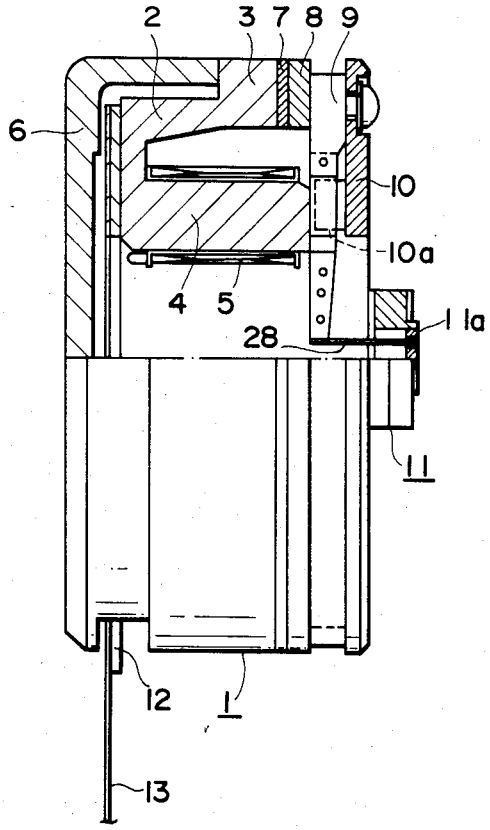
FIG. 2 is a schematic sectional view of the print head.

As shown in FIGS. 1 and 2, a yoke member 1 constitutes a magnetic circuit is formed of Co.Fe alloy called "Permendur" having a property of highly saturated magnetic flux density and consists of a substantially cylindrical outer yoke 3 and an inner yoke 2 located in spaced relation to the outer yoke 3 and having numerous comb-like portions 4 formed integrally on the same circumference at suitable pitches. Solenoid coils 5 are wound round the comb-like portions 4 to constitute an electromagnetic device. A rear casing 6 is glued to the rear side of the outer yoke 3, and an annular permanent magnet 7 and a holding member 8 are glued to the front side of the outer yoke 3. On the other hand, a plurality of actuators 9 are each secured by screws to the end portion at the outer peripheral side of the rear face of a front yoke 10 in radially corresponding relation to each of the comb-like portions 4. The front yoke 10 with each of the actuators 9 secured thereto by screws is located relative to the holding member 8 by pins (not shown) projecting from the holding member 8, each of the actuators 9 is magnetically attracted to the member 8 by the magnetic force of the permanent magnet 7. A plurality of projections 10*a* extending between armatures 21 to be explained later are each integrally formed on the rear face of the front yoke 10 to form a magnetic circuit leading to the actuator 9 and the yoke 4. A rectangular guide 11 having numerous guide holes 11*a* arranged in the form of rhombus is mounted on the front side of the front yoke 10, and serves to guide slidably the end portion at the printing side of each of printing wires 28 bonded by brazing to the free end of the actuators 9 and extending substantially linearly. Further, the electrical lead end of each of the solenoid coils 5 wound around the comb-like portions 4 is soldered on a flexible cable 13 attached to a base plate 12. The electrical wire of the flexible cable 13 is connected to a solenoid driving means (not shown) within the printer proper, whereby exciting current is selectively supplied to each of the solenoid coils 5.

Figure 3:
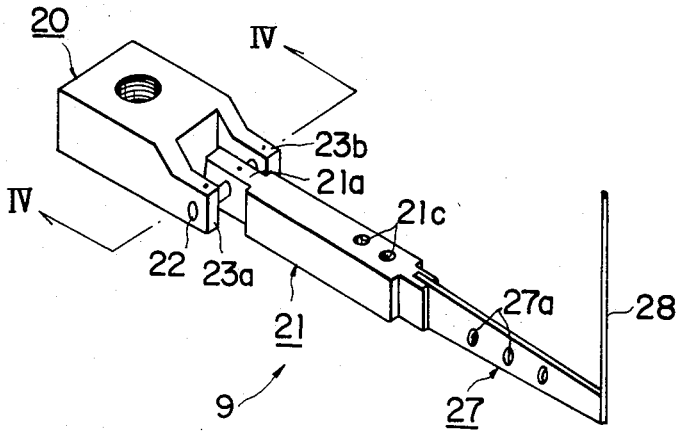
FIG. 3 is a perspective view of an actuator.
Figure 4:
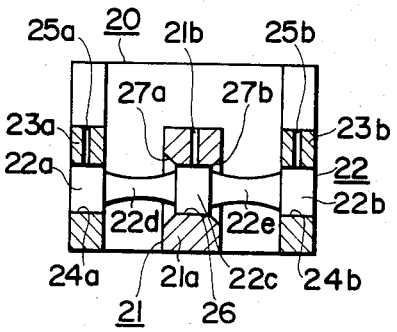
FIG. 4 is a sectional view taken along the line IV—IV of FIG. 3.
Figure 5:
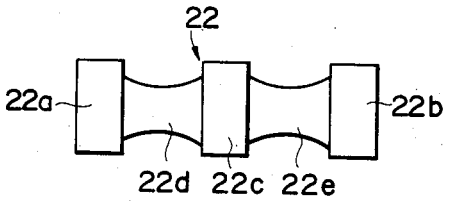
FIG. 5 is an enlarged view of a torsion spring.

Referring to FIGS. 3 and 4, each of the actuators 9 comprises a holder 20, an armature 21 arranged in opposed relation to the yoke 4, a torsion spring 22 which supports the armature 21 for swinging movement relative to the holder 20, and a wire holder 27. The holder 20 is fixedly secured at its base end to the end portion at the outer peripheral side of the rear face of the front yoke 10, and is formed at its top end portion with bifurcated portions 23*a*, 23*b*. These bifurcated portions 23*a*, 23*b* are provided with through-holes 24*a*, 24*b*, into which both axial end portions of the torsion spring 22 are fitted and fixed by brazing. Further, these bifurcated portions 23*a*, 23*b* are formed with holes 25*a*, 25*b* for solder material communicating with the through-holes 24*a*, 24*b*, and these solder holes are filled with solder material such as palladium solder, silver solder, gold solder or the like in the form of pellet or rod when bonding the holder 20 to the torsion spring 22 by brazing.

Each of the armatures is constructed of Co.Fe alloy called "Permendur" having a property of highly saturated magnetic flux and constitutes a magnetic circuit together with the comb-like portion 4 and the projection 10*a*. The armature 21 is formed with a through-hole 26 at the opposite end portion 21*a* positioned between the bifurcated portions 23*a* and 23*b*, into which the axial central portion of the torsion spring 22 is fitted and fixed by brazing. Further, a wire holder 27 is bonded by brazing to the top end portion of the armature 21. A printing wire 28 shaped in tapered form from the end at the printing side to the base end is bonded by brazing to the top end portion of the wire holder 27. The armature 21 is also formed at the opposite end portion 21*a* with solder hole 21*b* communicating with the through-hole 26, and the solder hole 21*b* is filled with solder material when bonding the armature 21 and the bifurcated portion 23*a*, 23*b* by brazing. The armature 21 is formed at its front end side with drill holes 21*c*, which eliminates excessive material portions unnecessary for the magnetic circuit leading to the projection 10*a* to thereby reduce the mass. Further, the wire holder 27 is also formed with holes 27*a* to reduce the mass.

The above-mentioned torsion springs are made of maraging steel consisting of high nickel steel containing extremely low carbon, or JIS (Japanese Industrial Standard), 15-7 PH, 17-7 PH stainless steel of percipitation hardening type martensite system. The torsion spring 22 is formed with larger diameter portions 22*a*–22*c* at both the end portions and the central portions in the axial direction which are fitted into and fixed to the inner wall of the through-hole 24*a*, 24*b* and 26. Moreover, the intermediate portions 22*d*, 22*e* interposed between these larger diameter portions 22*a*–22*c* are formed in the concave section such that they become progressively greater in diameter with the approach to the larger diameter portions 22*a*–22*c*. This makes it difficult for torsional stress actuating at the time of printing operation to concentrate in the boundary portions between the larger diameter portions 22*a*–22*c* and the intermediate portions 22*d*, 22*e*.

According to one aspect of the invention, the through-hole 26 of the armature 21 is formed at both end openings with bevelling portions 27*a*, 27*b*, with the section of the through hole 26 corresponding to the axial length of the larger diameter portion 22*c* of the torsion spring 22 being left as it is.

Figure 8:
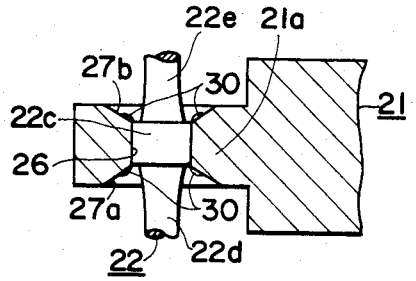
FIG. 8 is a fragmentary sectional view illustrating an improved example in which the openings at both ends of the through hole of the armature have bevellings to which solder material leaked out adhers.

As shown in FIG. 8, with the bevelling portions 27*a*, 27*b* formed at both end openings of the through-hole of the armature 21, when the armature 21 is bonded by brazing to the torsion spring 22, solder material 30 leaked out through the clearance between the larger diameter portion 22*c* and the through-hole 26 adheres to the bevelling portions 27*a*, 27*b* without filling the space between the through hole 26 and the intermediate portions 22*d*, 22*e*. Thus a spring constant of the torsion spring 22 is maintained substantially at a constant value. As a result, each of the torsion springs 22 at the time of printing operation permits the respective armatures 21 to be swung with substantially uniform torque for effecting printing operation.

Figure 9:
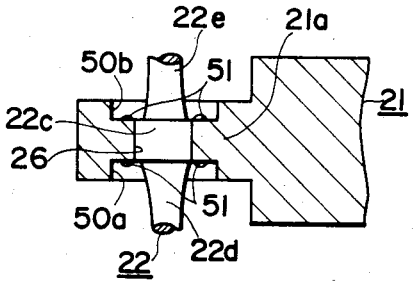
FIG. 9 is a fragmentary sectional view illustrating another improved example in which the openings of the through holes have facings to which solder material leaked out adhers.

Alternatively, as shown in FIG. 9, it is possible to form facing portions 50*a*, 50*b* at the openings of the through-hole 26, leaving the section corresponding to the axial length of the larger diameter portion 22*c*, so that solder material 51 leaked out at the time of brazing adheres to the facing portions 50*a*, 50*b* without filling the space between the through hole 26 and the intermediate portions 22*d*, 22*e*.

Moreover, the torsion spring 22 can be easily produced either by a grinding process comprising grinding a spring material by means of grinding device having a grinding wheel of the outer periphery in the form of circular arc corresponding to the concave profile of the intermediate portions 22*d*, 22*e*, so that the larger diameter portions 22*a*–22*c* and the concave sectional intermediate portions 22*d*, 22*e* are integrally formed, or by a rolling process comprising rolling a spring material while pressing against the outer peripheral face of the material the rolling dies having the form corresponding to the concave profile of the intermediate portions 22*d*, 22*e* to thereby deform plastically the outer periphery of the spring material, whereby the larger diameter portions 22*a*–22*c* and the biconcave intermediate portions 22*d*, 22*e* are integrally formed.

Alternatively, it is also possible to form bifurcated portions at the base end of an armature, locate an opposite end portion of a holder between the bifurcated ends, and support the armature by a torsion spring for swinging movement.

Next, the operation of the print head according to the invention will be explained.

As shown in FIG. 2, in each of the actuators 9, when the solenoid coil 5 is not energized, the armature 21 is swung toward the comb-like portion 4 about the torsion spring 22 against the spring force thereof by the magnetic force of the permanent magnet 7 and attracted magnetically to the comb-like portion 4. In this condition, the printing end of the printing wire 28 is positioned slightly inwardly of the front face of the guide 11.

Figure 6:
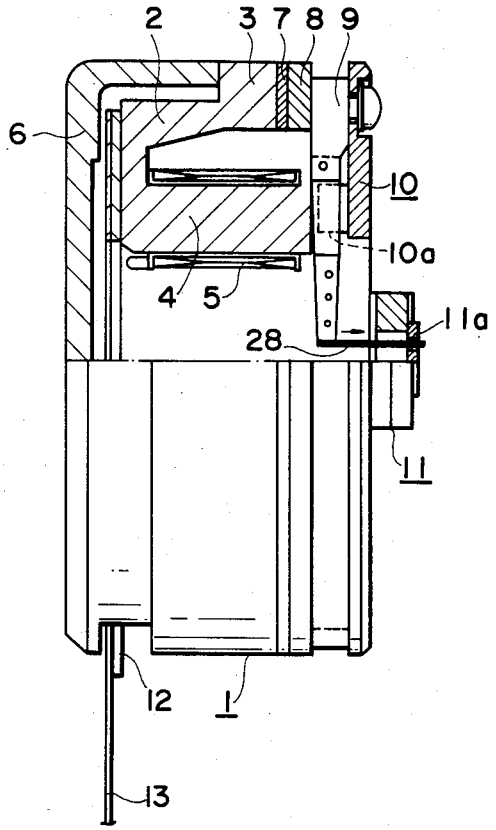
FIG. 6 is a schematic longitudinal sectional view of the print head illustrating the printing operation of an actuator.
Figure 7:
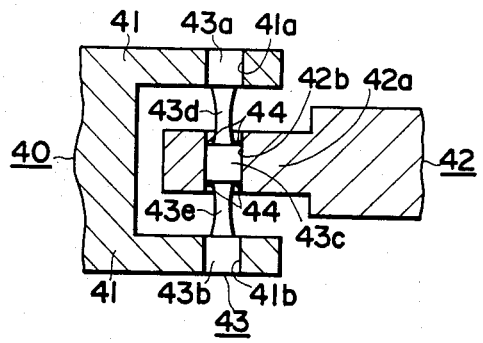
FIG. 7 is a fragmentary sectional view depicting the new torsion spring configuration of the present invention which also illustrate the prior art in which solder material leaked out from the clearance betwen the larger diameter portion of a torsion spring and the through hole of an armature adversely affects a spring constant of the torsion spring.

On the other hand, as shown in FIG. 6, when exciting current is supplied to the solenoid coil 5 through the flexible cable 13 according to a printing signal transmitted selectively, the magnetic force of the permanent magnet 7 is cancelled by the magnetic circuit of the solenoid coil 5 formed between the projection 10*a* and the comb-like portion 4, so that the armature 21 is released from the magnetic force of the permanent magnet 7. This causes the armature 21 to be swung in the direction of arrow mark of full line by the spring force of the torsion spring 22, so that the printing end of the printing wire 28 projects out of the front face of the guide 11 and prints letters on a paper material in a manner of dot matrix. When the armature 21 is swung, torsional stress acts on the boundary portions between the holder 20 and the torsion spring 22 and between the armature 21 and the torsion spring 22.

Such torsional stress $\tau$ is generally obtained by $\tau max. = 16T/\pi d^3\{T = WL$ (W: couple of forces, L: length), d: diameter$\}$, and assuming that couple of forces W and length L are constant, the torsional stress $\tau$ is determined by diameter d of the torsion spring 22. This means that torsional stress produced in the larger diameter portions 22*a*–22*c* bonded by brazing to the holder 20 and the armature 21 is lower than in other portions. Further, since the intermediate portions 22*d*, 22*e* are formed such that they become larger in diameter with the approach to the respective larger diameter portions 22*a*–22*c*, torsional stress is prevented from being concentrated in the boundary portions between the intermediate portions 22*d*, 22*e* and the larger diameter portions 22*a*–22*c*. This in turn prevents the torsion spring 22 from being broken at the boundary portions between the intermediate portions 22*d*, 22*e* and the larger diameter portions 22*a*–22*c*.

With the concave sectional intermediate portions 22*d*, 22*e* positioned between the larger diameter portions 22*a*–22*c* according to the invention, torsional stress will not be concentrated at the boundary portions between the intermediate portions 22*d*, 22*e* and the larger diameter portions 22*a*–22*c* at the time of printing operation, and hence the torsion spring can be reduced in torsional stress acting on the boundary portions, whereby a print head which is higher in durability and reliability can be provided. Besides, with the openings at both ends of the through hole of the armature having the bevelling or facing portions leaving the section corresponding to the axial length of the larger diameter portion of the torsion spring, the armature can be swung with uniform spring force of the torsion spring without being adversely affected by solder material leaked out, and hence a print head can be provided which permits printing operation with higher printing quality to be performed.

What is claimed is:

1. A print head for dot printers comprising a plurality of actuators each including an armature supported on a holder through a torsion spring and having at an actuator end a printing wire with a wire end which is swingably driven to print letters with the wire end, wherein one of said holder and armature has a bifurcated end portion and the other of said holder and armature has an opposite end portion located between said bifurcated ends, said bifurcated end portion and said opposite end portion having through-holes with innerwalls which are provided in axial alignment relation with one another, and said torsion spring is inserted into and bonded to the inner wall of said through-holes by soldering, said torsion spring having a central axis, bonding portions disposed in said through-holes, and intermediate portions separating said bonding portions, said intermediate portions having a smaller diameter than a diameter of said bonding portions, said intermediate portions being defined by upper and lower arched curves concave in the middle and symmetrically disposed with respect to said central axis.

2. A print head for dot printers comprising a plurality of actuators each including an armature supported on a holder through a torsion spring and having at an actuator end a printing wire with a wire end which is swingably driven to print letters with the wire end, wherein one of said holder and armature has a bifurcated end portion and the other of said holder and armature has an opposite end portion located between said bifurcated ends, said bifurcated end portion and said opposite end portion having through-holes with inner walls which are provided in axial alignment with one another, and said torsion spring having a pair of spring end portions, a center portion and two intermediate portions positioned axially between each of the spring end portions and the center portion, said intermediate portions each being smaller in diameter than the end portions and the center portion, said torsion spring being inserted in and bonded to said through-holes through said end portions and center portion by soldering, said opposite end portion having a thickness larger than an axial length of the center portion of the torsion spring, said opposite end portion having means consisting of two recessed end openings for housing any excess bonding solder from the through-holes whereby said excess bonding solder does not affect a predetermined spring constant of said torsion spring.

3. The print head as set forth in claim 2 wherein the end openings are inwardly tapered recessed facing portions.

4. The print head as set forth in claim 2 wherein said end openings comprise recessed facing portions.

* * * * *